US011585174B2

(12) United States Patent
Yan et al.

(10) Patent No.: US 11,585,174 B2
(45) Date of Patent: Feb. 21, 2023

(54) HYDRAULIC PROPULSION HORIZONTAL DIRECTIONAL CORING DEVICE

(71) Applicant: China University of Geosciences (Wuhan), Hubei (CN)

(72) Inventors: Xuefeng Yan, Hubei (CN); Cong Zeng, Hubei (CN); Peng Zhang, Hubei (CN)

(73) Assignee: China University of Geosciences (Wuhan), Hubei (CN)

( * ) Notice: Subject to any disclaimer, the term of this patent is extended or adjusted under 35 U.S.C. 154(b) by 0 days.

(21) Appl. No.: 17/515,557

(22) Filed: Nov. 1, 2021

(65) Prior Publication Data

US 2022/0049563 A1 Feb. 17, 2022

(30) Foreign Application Priority Data

Jun. 11, 2021 (CN) ..... 202121318340.0

(51) Int. Cl.

| | |
|---|---|
| ***E21B 25/00*** | (2006.01) |
| ***E21B 17/10*** | (2006.01) |
| ***E21B 7/04*** | (2006.01) |

(52) U.S. Cl.

CPC ..... *E21B 25/00* (2013.01); *E21B 7/046* (2013.01); *E21B 17/1078* (2013.01)

(58) Field of Classification Search

CPC ..... E21B 25/00; E21B 7/046; E21B 17/1078

See application file for complete search history.

(56) References Cited

U.S. PATENT DOCUMENTS

| | | | | |
|---|---|---|---|---|
| 1,582,904 | A * | 5/1926 | Thurman | E21B 10/02 294/86.11 |
| 4,296,822 | A * | 10/1981 | Ormsby | E21B 31/06 175/255 |
| 9,580,982 | B2 * | 2/2017 | Kvinnesland | E21B 25/00 |
| 2014/0027182 | A1 * | 1/2014 | Wilson | E21B 25/00 175/58 |
| 2022/0042387 | A1 * | 2/2022 | Yan | E21B 17/1078 |

* cited by examiner

*Primary Examiner* — Jonathan Malikasim

(57) ABSTRACT

A hydraulic propulsion horizontal directional coring device includes a casing pipe, a coring tube assembly and a conversion adapter. Both the casing pipe and the coring tube assembly coaxially set within the casing pipe are tubular. The conversion adapter, having a cylindrical structure fitted with the casing pipe, is coaxially set at a back side of the coring tube assembly and is slidably connected with an inner wall of the casing pipe. Under an action of an external force, the conversion adapter pushes the coring tube assembly to move along an axial direction of the casing pipe till a front end of the coring tube assembly extends out of or retracts into the casing pipe. The conversion adapter and the coring tube assembly have a first channel and a second channel axially provided therein, respectively. The first channel is connected with the second channel.

4 Claims, 1 Drawing Sheet

HYDRAULIC PROPULSION HORIZONTAL DIRECTIONAL CORING DEVICE

CROSS REFERENCE OF RELATED APPLICATION

The present invention claims priority under 35 U.S.C. 119(a-d) to CN 202121318340.0, filed Jun. 11, 2021.

BACKGROUND OF THE PRESENT INVENTION

Field of Invention

The present invention relates to the field of geological investigation, and more particularly to a hydraulic propulsion horizontal directional coring device.

Description of Related Arts

At present, with the increase of long-distance and deep-buried tunnel projects, traditional vertical drilling survey methods have encountered great challenges and brought many problems if it's still used. For example, the obtained stratum information is unable to meet the needs of engineering design; the drilling holes are too small in the effective drilling length, are too deep in the depth and are too much in the number; the method is costly and greatly restricted by topography.

Horizontal directional drilling technology uses equipment which has directional control to lay water supply, electricity, telecommunications, natural gas, coal gas, oil and other pipelines without excavating the ground surface. This technology is relatively mature, and has the advantages of high precision, low cost and so on. The drilling survey of horizontal directional drilling rigs along the extension direction of the tunnel has the advantages of good terrain adaptability, easy access to geological parameters and a lot of information, and long effective drilling length, witch can solve the problems of traditional methods. Therefore, horizontal directional drilling technology is a good alternative technology and has broad application prospects.

In case of vertical drilling discontinuous coring, the sequence of drilling first, following lifting up the drilling tool, replacing the coring tube and finally drilling into the ground again is commonly adopted. However, in the process of horizontal directional drilling, the drill rod does not rotate. And during vertical drilling, there is no front centralizer provided for the coring tube cause the coring tube is directly exposed to the exterior, so that the coring tube is easy to shake while drilling, resulting in poor hole quality. Even the coring tube slips at the bottom of the hole, and is unable to be drilled into the rock directionally, in severe cases, the coring tube is broken. Therefore, the discontinuous coring of the existing vertical drilling coring technology is unable to be directly applied to the horizontal directional drilling engineering geological survey. The horizontal directional drilling coring technology for engineering geological survey also faces some other urgent issues: how to provide in-well power, how to ensure that the survey hole is concentrically and coaxially provided with the full-face drilling hole, how to deal with the falling of hole walls while coring through horizontal holes, and how to improve the coring rate while coring through fractured zones.

SUMMARY OF THE PRESENT INVENTION

To overcome shortcomings of prior arts, the present invention provides a hydraulic propulsion horizontal directional coring device.

Accordingly, the hydraulic propulsion horizontal directional coring device comprises a casing pipe, coring tube assembly and a conversion adapter, wherein:

both the casing pipe and the coring tube assembly are tubular, and the coring tube assembly is coaxially set within the casing pipe;

the conversion adapter, having a cylindrical structure fitted with the casing pipe, is coaxially set at a back side of the coring tube assembly and is slidably connected with an inner wall of the casing pipe;

under an action of an external force, the conversion adapter pushes the coring tube assembly to move along an axial direction of the casing pipe till a front end of the coring tube assembly extends out of or retracts into the casing pipe;

the conversion adapter and the coring tube assembly have a first channel and a second channel axially provided therein, respectively, wherein the first channel and the second channel penetrate through the conversion adapter and the coring tube assembly, respectively; the first channel is connected with the second channel.

Preferably, the casing pipe comprises an arched transition portion at a front end thereof, a first centralizer is located at a front end of an interior of the casing pipe and is in fixed connected with the inner wall of the casing pipe, the coring tube assembly penetrates through the first centralizer, a second centralizer is located at a front end of an exterior of the casing pipe.

Preferably, the coring tube assembly comprises a screw rod and a coring tube, wherein an interior of the screw rod is hollow, two ends thereof have openings, respectively; the screw rod is coaxially fixed within the casing pipe; a front end of the conversion adapter is in fixed connection with a back end of the screw rod; the coring tube, having a tubular structure, is coaxially set at a front end of the screw rod, a back end of the coring tube is in fixed connection with the front end of the screw rod, a front end of the coring tube passes through the first centralizer, the back end of the coring tube has a through-hole communicated with an interior of the screw rod.

Preferably, a circlip is coaxially set at the front end of the coring tube.

Preferably, a limit ring is coaxially set within the casing pipe, is in fixed connection with the inner wall of the casing pipe and is located at a back side of the conversion adapter.

The present invention has some beneficial effects as follows. The hydraulic propulsion horizontal directional coring device provided by the present invention is able to take the core by using HDD technology, ensures that the survey hole is concentrically and coaxially provided with full-face drilling hole. At the same time, the casing is also able to ensure that the coring tube is not disturbed by the drilling block. Moreover, the coring device has advantages of its simple structure, convenient operation, strong practicality and so on.

DETAILED DESCRIPTION OF THE PREFERRED EMBODIMENT

To make the objectives, technical solutions and advantages of the present invention more clearly, the present invention is further described in details with accompanying drawings as follows.

Figure 1:
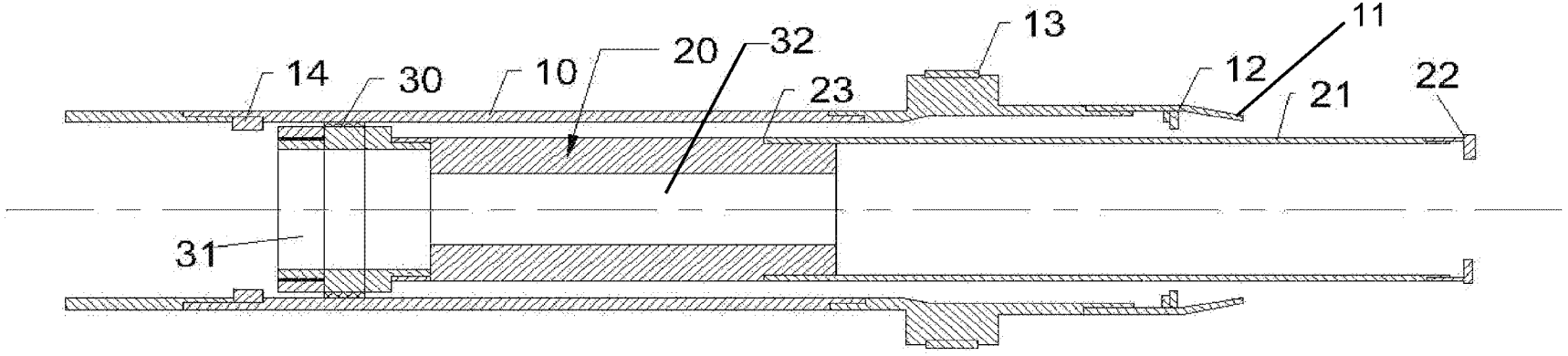
FIG. 1 is a structural presentation of a hydraulic propulsion horizontal directional coring device provided by the present invention.
Figure 2:
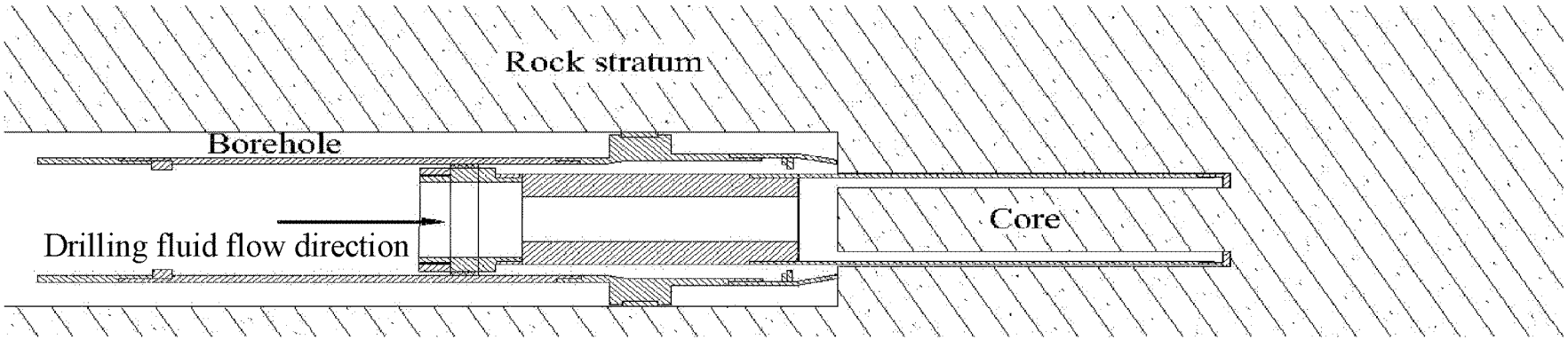
FIG. 2 is another structural presentation of the hydraulic propulsion horizontal directional coring device provided by the present invention.

Referring to FIGS. 1 and 2, a hydraulic propulsion horizontal directional coring device according to a preferred embodiment of the present invention is illustrated, wherein the hydraulic propulsion horizontal directional coring device comprises a casing pipe 10, a coring tube assembly and a conversion adapter 30. Both the casing pipe 10 and the coring tube assembly are tubular, and the coring tube assembly is coaxially set within the casing pipe 10. The conversion adapter 30, having a cylindrical structure fitted with the casing pipe 10, is coaxially set at a back side of the coring tube assembly and is slidably connected with an inner wall of the casing pipe 10. Under an action of an external force, the conversion adapter 30 pushes the coring tube assembly to move along an axial direction of the casing pipe 10 till a front end of the coring tube assembly extends out of or retracts into the casing pipe 10. The conversion adapter 30 and the coring tube assembly have a first channel 31 and a second channel 32 axially provided therein, respectively; the first channel 31 and the second channel 32 penetrate through the conversion adapter 30 and the coring tube assembly, respectively; the first channel 31 is connected with the second channel 32.

According to the preferred embodiment of the present invention, there is a gap between the coring tube assembly and the casing pipe 10, the conversion adapter 30 is configured to be connected with a drill pipe. Specifically, the conversion adapter 30 is a piston joint. The conversion adapter 30 is in a sealed connection with the inner wall of the casing pipe 10, so as to prevent impurities from entering the gap between the coring tube assembly and the casing pipe 10. A front end of the drill pipe is in a detachable connection with the conversion adapter 30, and preferably, the detachable connection is threaded connection or clamp connection. According to the preferred embodiment of the present invention, the external force is a driving force provided by drilling fluid or mud, the drilling fluid or mud enter the casing pipe 10, and flows through the first channel 31 and the second channel 32 in sequence, and then enter the coring tube assembly. The conversion adapter 30 drives the coring tube assembly to move forwardly till the front end of the coring tube assembly extends out of the casing pipe 10 to drill the core.

According to the preferred embodiment of the present invention, the casing pipe 10 comprises an arched transition portion 11 at a front end thereof, a first centralizer 12 is located at a front end of an interior of the casing pipe 10 and is in fixed connected with the inner wall of the casing pipe 10, the coring tube assembly penetrates through the first centralizer 12, a second centralizer 13 is located at a front end of an exterior of the casing pipe 10.

According to the preferred embodiment of the present invention, both the first centralizer 12 and the second centralizer 13 are able to be bearings or copper sheets. The first centralizer 12 is able to prevent the coring tube assembly from swinging in a large direction within the casing pipe 10. The second centralizer 13 is configured to provide support for the casing pipe 10. Both the first centralizer 12 and the second centralizer 13 are able to ensure that the survey hole is concentrically and coaxially provided with full-face drilling hole. The arched transition portion 11 is able to reduce the resistance of the casing pipe 10 during drilling and ensure the moving efficiency of the coring device.

According to the preferred embodiment of the present invention, the coring tube assembly comprises a screw rod 20 and a coring tube 21, wherein an interior of the screw rod 20 is hollow, two ends thereof have openings, respectively; the screw rod 20 is coaxially fixed within the casing pipe 10; a front end of the conversion adapter 30 is in fixed connection with a back end of the screw rod 20; the coring tube 21, having a tubular structure, is coaxially set at a front end of the screw rod 20, a back end of the coring tube 21 is in fixed connection with the front end of the screw rod 20, a front end of the coring tube 21 passes through the first centralizer 12, the back end of the coring tube 21 has a through-hole 23 communicated with an interior of the screw rod 20.

According to the preferred embodiment of the present invention, the screw rod 20 is configured to drive the coring tube 21 to move. The coring tube assembly has advantages of simple structure and strong practicality. The interior of the screw rod 20 is communicated with the coring tube 21 for forming the second channel 32.

According to the preferred embodiment of the present invention, a circlip 22 is coaxially set at the front end of the coring tube 21.

According to the preferred embodiment of the present invention, the circlip 22 is able to ensure that the core will be broken when the drill pipe is lifted, thereby ensuring the core drilling rate and drilling effect.

According to the preferred embodiment of the present invention, a limit ring 14 is coaxially set within the casing pipe 10 and is in fixed connection with the inner wall of the casing pipe 10; and moreover, the limit ring 14 is located at a back side of the conversion adapter 30.

According to the preferred embodiment of the present invention, the limit ring 14 is configured to limit the movement path of the conversion adapter 30 and to also prevent the conversion adapter 30 from detaching from the casing pipe 10 in combination with the first centralizer 12. The conversion adapter 30 moves between the limit ring 14 and the first centralizer 12.

In the above description, the directional terms such as "front", "back", "upper" and "lower" are defined in terms of the positions of the parts in the drawings and the positions between the parts in the drawings, which is just for the clarity and convenience of expressing technical solutions. It should be understood that the use of the directional terms should not limit the protection scope of the present invention.

In the case of no conflict, the above-mentioned embodiment and the features in the embodiment herein are able to be combined with each other.

The above is only the preferred embodiment of the present invention and is not intended to limit the present invention. Any modification, equivalent replacement and improvement made within the spirit and principle of the present invention shall be included in the protection scope of the present invention.

What is claimed is:

1. A hydraulic propulsion horizontal directional coring device, which comprises a casing pipe (10), a coring tube assembly and a conversion adapter (30), wherein:

both the casing pipe (10) and the coring tube assembly are tubular, and the coring tube assembly is coaxially set within the casing pipe (10);

the conversion adapter (30), having a cylindrical structure fitted with the casing pipe (10), is coaxially set at a back side of the coring tube assembly and is slidably connected with an inner wall of the casing pipe (10);

under an action of an external force, the conversion adapter (30) pushes the coring tube assembly to move along an axial direction of the casing pipe (10) till a front end of the coring tube assembly extends out of or retracts into the casing pipe (10);

the conversion adapter (30) and the coring tube assembly have a first channel (31) and a second channel (32) axially provided therein, respectively, wherein the first channel (31) and the second channel (32) penetrate through the conversion adapter (30) and the coring tube assembly, respectively; the first channel (31) is communicated with the second channel (32);

the casing pipe (10) comprises an arched transition portion (11) at a front end thereof, a first centralizer (12) is located at a front end of an interior of the casing pipe (10) and is in fixed connected with the inner wall of the casing pipe (10), the coring tube assembly penetrates through the first centralizer (12), a second centralizer (13) is located at a front end of an exterior of the casing pipe (10).

2. The hydraulic propulsion horizontal directional coring device according to claim 1, wherein the coring tube assembly comprises a screw rod (20) and a coring tube (21), wherein an interior of the screw rod (20) is hollow, two ends of the screw rod (20) have openings, respectively; the screw rod (20) is coaxially fixed within the casing pipe (10); a front end of the conversion adapter (30) is in fixed connection with a back end of the screw rod (20); the coring tube (21), having a tubular structure, is coaxially set at a front end of the screw rod (20), a back end of the coring tube (21) is in fixed connection with the front end of the screw rod (20), a front end of the coring tube (21) passes through the first centralizer (12), the back end of the coring tube (21) has a through-hole (23) communicated with an interior of the screw rod (20).

3. The hydraulic propulsion horizontal directional coring device according to claim 2, wherein a circlip (22) is coaxially set at the front end of the coring tube (21).

4. The hydraulic propulsion horizontal directional coring device according to claim 1, wherein a limit ring (14) is coaxially set within the casing pipe (10), is in fixed connection with the inner wall of the casing pipe (10) and is located at a back side of the conversion adapter (30).

* * * * *